United States Patent [19]

Lohse

[11] 4,121,937

[45] Oct. 24, 1978

[54] PHOTOGRAPHIC PROCESS FOR THE PRODUCTION OF PICTURES OF INCREASED CONTRAST

[75] Inventor: Karl Heinz Lohse, Costa Mesa, Calif.

[73] Assignee: STB Strahlentechnische Bilddiagnostik Heinz Fleck, Fed. Rep. of Germany

[21] Appl. No.: 770,118

[22] Filed: Feb. 18, 1977

[30] Foreign Application Priority Data

Feb. 20, 1976 [DE] Fed. Rep. of Germany ..... 2607482

[51] Int. Cl.[2] ..... G03C 5/06; G03C 7/04

[52] U.S. Cl. ..... 96/44; 96/6; 96/27 R

[58] Field of Search ..... 96/44, 6, 27 R

[56] References Cited

U.S. PATENT DOCUMENTS 1,967,057 7/1934 Irvine ..... 96/44

2,144,066 1/1939 Kindermann ..... 96/44 X 2,378,213 6/1945 Glashoe ..... 96/6

*Primary Examiner*—Edward C. Kimlin

*Assistant Examiner*—Alfonso T. Suro Pico

*Attorney, Agent, or Firm*—Andrus, Sceales, Starke & Sawall

[57] ABSTRACT

In order to increase the contrast of a picture such as an X-ray picture over a selected range of densities, a negative transparency of the original picture of selected density value at one end of the selected range and a positive transparency of the original picture at the other end of the selected range are superimposed to form a transparency sandwich and the image produced by illuminating such a transparency sandwich is photographed or displayed. A number of selected density ranges may be superimposed on a single display by making a respective transparency sandwich for each range in a different color and superimposing such transparency sandwiches.

23 Claims, 4 Drawing Figures

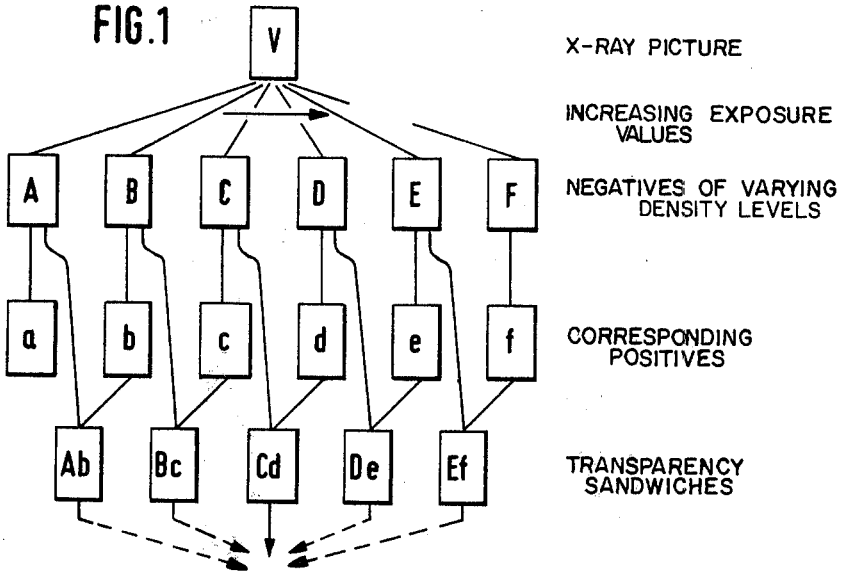
FIG.1
V
X-RAY PICTURE
INCREASING EXPOSURE VALUES
A
B
C
D
E
F
NEGATIVES OF VARYING DENSITY LEVELS
a
b
c
d
e
f
CORRESPONDING POSITIVES
Ab
Bc
Cd
De
Ef
TRANSPARENCY SANDWICHES
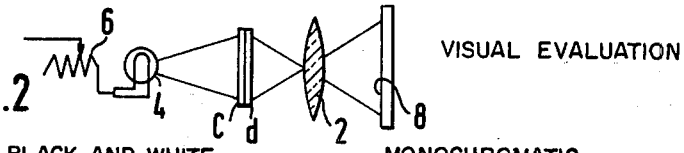
FIG.2
6
4
C
d
2
8
VISUAL EVALUATION
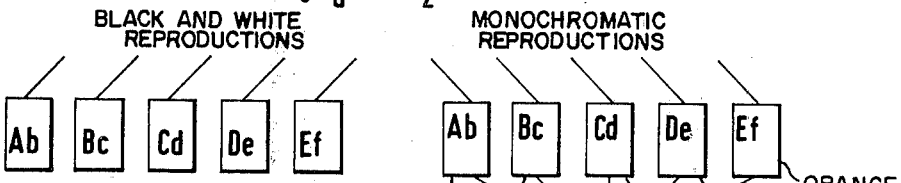
BLACK AND WHITE REPRODUCTIONS
Ab
Bc
Cd
De
Ef
MONOCHROMATIC REPRODUCTIONS
Ab
Bc
Cd
De
Ef
ORANGE
RED
GREEN
BLUE
YELLOW
FIG.3
FIG.4
COLOR SANDWICH
10
COLOR PHOTOGRAPHY
12
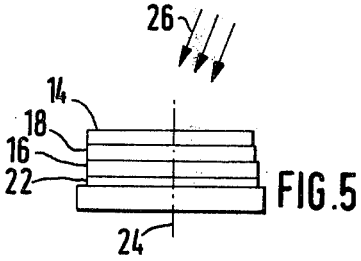
26
14
18
16
22
24
FIG.5

PHOTOGRAPHIC PROCESS FOR THE PRODUCTION OF PICTURES OF INCREASED CONTRAST

BACKGROUND OF THE INVENTION — FIELD OF THE INVENTION

This invention relates to a process for the production of pictures of increased contrast from an original exposure especially an X-ray picture by photographic means, by masking a negative with a differently exposed positive.

BACKGROUND OF THE INVENTION — DESCRIPTION OF THE PRIOR ART

The diagnostic evaluation of X-ray pictures is often difficult because the sought after structures, especially incipient malignant changes, differ from their surroundings by only slight variations in density and absorption. For this reason, they appear in X-ray pictures with only correspondingly low shade density differences in relation to their surroundings.

Many processes have been proposed to alleviate this difficulty. In so far as they are concerned with photographic processes they either complicate making the picture because they require complex photographic devices or processes, or their results remain dependent on chance and the expertise of the operators. For the sake of completeness, it should be mentioned that non-photographic processes have also been proposed in order to modify the contrast of a transparency produced electrically or electronically by using electrical circuits. With this process, however, a considerable loss in resolution on conversion into an electrically controllable picture is unavoidable, the finer details being obscured by electronic background noise and even the smallest discernible differences in shade values are, with electronic imaging for example that produced on a television tube considerably greater than in photographic material. For this reason, the quality of electrical or electronic pictures is generally considerably worse than that of photographic pictures and naturally this is in no way altered when photographs of such electrical screen pictures are made. Thus, in spite of the high expense necessarily involved in providing electrical or electronic equipment, the results achieved are unsatisfactory for the purposes of carrying out delicate diagnosis.

Among the photographic processes for the modification of contrast, those in which modification of the contrast in achieved by masking a transparency with shading or brightening zones are of particular interest. With these processes, what is usually desired is reduction of contrast, namely matching the relatively large shade density range of a transparency to the relatively narrow shade density range of a picture on paper. Thus, it is particularly known to produce a more delicate positive transparency from a negative and then to copy the negative whilst masking with this positive transparency. This produces a flattening of the contrast which, because of the opposing bends of the contrast curves in the negative and in the positive, has the result that more details become visible than in a simple copy of the negative. Essentially, with processes of this kind it is in practice necessary to carry out the masking of the superimposed transparencies with varied exposure so as to avoid a too extensive mutual extinguishing of negative and positive.

SUMMARY OF THE PRESENT INVENTION

An object of the invention is to provide a simple and low cost but efficient and reliable, universally applicable process, which can be easily automated, for the improvement of detectability of picture information which is weak in contrast and which is particularly suitable for application in X-ray diagnosis.

According to the invention, there is provided a process for the production of pictures of an original exposure by photographic means by masking a negative with a differently exposed positive comprising the steps of:

a. producing a series of negative transparencies of varying densities by copying the original on transparent photographic material having sharp contrast using graduated exposure, b. selecting that pair of negative transparencies having densities which correspond approximately to the upper and lower limits of a selected density value range the contrast of which is to be strengthened, c. converting the negative transparency of the selected pair which was produced by stronger exposure to a corresponding positive transparency, d. superimposing, in proper registration, the positive transparency on the other negative transparency of the selected pair to produce a transparency sandwich, and e. irradiating a receiver through the transparency sandwich to produce a picture of the original with increased contrast.

In accordance with the process according to the invention, a certain density range of interest can be selected from any desired original exposure, in particular an X-ray negative, a Rontgen radiograph or a photograph of a screen picture of ultrasonic penetration of body tissue, and extended to a broader density range scale on the receiver, or graded density range can be represented as iso-densities. It is particularly important that a special technique need not be applied for the taking of the picture itself but that the normal illuminated panel can be used; only the photographs thus produced or already available are used as the original exposure. Thus a particular advantage of the process according to the invention is that a standardised process technique is sufficient for all normal circumstances. Thus, with a sufficiently fine grading of the series of transparencies in various density stages, it is possible to meet practically all demands arising for the evaluation of X-ray transparencies or the like with one and the same predetermined system of copying processes with definitely predetermined graded exposures and, in particular, exposure times. This makes it possible to automate the process to a great extent and as a result of this to produce a set of graded density negative transparencies and a set of the corresponding graduated positive transparencies, so that the evaluator without further ado can undertake any desired grouping of negative and positive into a sandwich transparency, wherewith, of course, it is practical to provide aids for facilitating the superimposition in a manner assuring proper registration.

In an embodiment which is particularly convenient and advantageous for practical evaluation, each negative transparency is superimposed on the positive transparency of the next highest stage of exposure in a manner to ensure proper registration, so as to form a sandwich. Thus the evaluator has only to select that sandwich with which the density range of interest of the original is pictured in enhanced contrast. This possibility of supplying a complete set of sandwiches is naturally somewhat more involved than the basically more simple possibility that the evaluator, especially an X-ray diagnostician, on receipt of the original exposure, normally a Rontgen radiograph or an ultrasonic photograph, marks that area of the picture in which an improved differentiation by heightening of the contrast should be effected, so that is is only necessary to produce and further process those sandwiches of which the dark areas extend from the upper to the lower limits of the density of the area of interest. It is clear, that in all these progressive steps enlargement or reduction procedures can be included.

The receiver can be a display screen for direct observation. In this case, the sandwich is used as a positive transparency in a normal projection procedure. Alternatively, the receiver can be a photographic image acceptance material which is further processed to provide a permanent picture. Both possibilities have their own advantages. With direct observation a further variation of the contrast can be achieved for example by varying the electric power fed to a display lamp in order to adjust the illumination to the level which is the most favourable for the contrasted representation of details in the desired density range. It is clear that such a visual control can also serve to aid determination of the most favourable exposure value for the subsequent exposure of a photographic image acceptance material. In many cases, it is practicable to exploit the range of shade values reproduced by the receiver, whether it is a display screen or a photographic reception material, to the fullest possible degree, which is achieved most easily by corresponding choice of the exposure or processing conditions according to the normal photographic rules. This, especially, a reception material can be used whose contrast is flatter than the contrast of the material used for the transparency sandwich, i.e. a "softer" material compared to the latter. Also the extent of the shade value range and contrast of a permanent picture can be influenced in a known manner by corresponding selection of the developing materials used and by adjustment of certain development conditions in a desired manner.

In many cases, evaluation will be simplified if the pictures produced by the transparency sandwiches are considered as iso-density reproductions; in fact, the more closely iso-density reproductions are approximated to, the finer is the grading of the exposures of the negative transparencies and positive transparencies and the harder is the image acceptance material which should be used. In other words, for the production of iso-density reproductions, it is practicable to use for the evaluation of transparency sandwiches, a photographic image acceptance material of sharp contrast.

It is particularly advantageous if the transparency sandwiches are processed to produce colour pictures because then a still better enhancement of contrast and detectability of detail can be achieved. Also, there is the additional important advantage that by the superimposition of several slides of different color, and also by colour mixtures, further possibilities of differentiation can be obtained. Particularly for this purpose, but also in general for a comprehensive evaluation especially in the form of iso-density reproductions, it is advantageous to produce the picture in monochromatic colour but to employ different colours for different transparency sandwiches of the same set.

Usually, in practice, a whole set of transparency sandwiches are produced from a single original exposure which together represent several, preferably all, of the density ranges of the original exposure. This enables particularly impressive and detailed results to be achieved which are diagnostically of great use if several, preferably all, of the monochromatic coloured pictures in the various colours are produced on transparency material and evaluated by through-transmitted illumination when superimposed in a manner ensuring proper registration. In order to obtain a permanent result, it is often preferred to retain this projected picture as a photograph on normal colour-sensitive image acceptance material.

When using these multi-colour reproductions, for the sake of simplicity, it is, in general, preferable to produce monochrome pictures from their transparency sandwiches on hard printing material. This yields, as an end result, an iso-density picture in which the different shade graduations of the original exposure are reproduced by different colours in one and the same picture.

In further processes using the described transparency sandwich made up of negative and positive transparencies, it can often be advantageous to accentuate the contours of contrast-rich structures in the original exposure. For this purpose especially, the known techniques can be applied according to which, for example, the positive and negative transparencies are offset one with respect to the other according to the desired thickness of the demarcation lines to be produced. Alternatively, the positive and negative transparencies of the sandwich and/or the sandwich and the printing material to be exposed through the sandwich, may be spaced apart by a distance corresponding to the desired thickness of the demarcation lines. Often, however, the distance of spacing provided by the thickness of the printing material is sufficient. In all these cases, in a further embodiment of the invention, particularly even and easily discernible demarcation lines are obtained, if, with a process for the production of enhanced contrast copies of a pictorial original exposure, especially according to the hereinbefore described process, a negative transparency produced from the original exposure and a corresponding positive transparency are superimposed to form a transparency sandwich, a photographic image acceptance material is exposed to light through the transparency sandwich and, on exposure of the image acceptance material to light, the sandwich is rotated about an axis inclined to the direction of incidence of light, so that the photographic image acceptance material is developed to form an outline picture in which shade value transitions in the original exposure are reproduced by demarcation lines. The light employed for exposure is directed in suitable manner, for example, light from a point source or, especially a parallel beam of light may be used. In the simplest case the axis of rotation is normal to both the sandwich and the image acceptance material which is exposed to light therethrough.

The process according to the invention can also be employed together with, or as an extension of another process of contrast modification, especially if the original exposure has already been enhanced according to another process.

The process according to the invention can also be advantageously employed to remove undesired picture features, in particular those shade gradation areas of no interest, during the reproduction of the original exposure. The process can also be of significance for an automated diagnostic evaluation of original exposures presented in large quantities.

BRIEF DESCRIPTION OF THE DRAWING

Embodiments of the invention will now be described in more detail with reference to the accompanying drawings, in which:

FIG. 1 is a schematic diagram illustrating a process in accordance with the invention, FIGS. 2 to 4 illustrate schematically various evaluations of transparency sandwiches, and FIG. 5 illustrates schematically the production of demarcation lines.

DETAILED DESCRIPTION OF THE PREFERRED EMBODIMENT

According to FIG. 1 an X-ray picture V serving as the original exposure and which is assumed here to be a positive, although it can also be a normal X-ray negative in relation to the structure pictured in it, is processed with graded exposure times, for example, in the ratio of 1:2:4:8:16:32, using a hard image acceptance material to produce six negative transparencies A to F each having a respective density gradation. It will be clear that a greater or small number of density gradations may be used. From the six varying density level negative transparencies, corresponding density positive transparencies *a, b, c, d, e* and *f* are produced on the same image acceptance material with the same exposures. Then, transparency sandwiches A*b*, B*c*, C*d*, D*e*, E*f* are produced in a manner providing proper registration, in each sandwich, a negative transparency being assembled with a positive transparency of the next higher duration of exposure. With ideally hard image acceptance material, only the parts corresponding to a definite density range of the original exposure are transparent. When softer image acceptance material is used, there is produced within these density ranges a more or less strong differentiation of shades of grey.

FIG. 2 illustrates schematically a method of assessing transparency sandwiches by visual evaluation. The transparency sandwich C*d* is projected on to a screen 8 by an optical system 2 and a light source 4 the brightness of which is adjustable by means of a variable resistance 6.

FIG. 3 illustrates a method of copying black and white reproductions from the transparency sandwiches. These then are, as an extreme case, pure iso-density reproductions, namely if image acceptance material of sufficient hardness was used. In another extreme case, various density ranges of the original exposure are reproduced over the largest possible density range of the image acceptance material which is used when copying the transparency sandwiches; this extension of the density range produces the required enhancement of contrast and better detectability of detail which was scarcely, if at all, recognisable in the original exposure, because of the differences of density being too low.

FIG. 4 illustrates the evaluation of transparency sandwiches comprising monochrome reproductions each of which has a respective different colour. If a hard image acceptance material is used for this purpose, and preferably also the transparency sandwiches are produced on hard material, then the extreme case is approached in which the monochrome reproductions produced are iso-density reproductions. If softer image acceptance reproduction material is used, more or less strong colour density differentiations are produced in the monochrome reproductions A*b* to E*f*. The monochrome reproductions can, when transparency pictures are produced, be observed in a transparency as a colour sandwich 10 when placed together in a registering manner. In contrast to the black and white reproductions according to FIG. 3, which when superimposed only lead to greater darkening and in the extreme case to a completely black picture, there is produced, as a transparency evaluation of the colour sandwich 10, a colour-coded iso-density, combined reproduction, which, for example, can be retained on a colour photograph 12.

FIG. 5 illustrates the described process for the production of demarcation lines. A transparency sandwich made from a transparency negative 14 of selected density and a positive transparency 16 of higher exposure separated by the interposition of a transparent spacer material 18 are arranged on a rotating table 20 above a photographic image acceptance material 22. The rotating table is rotated around an axis 24 which is normal to the transparency sandwich and the image acceptance material 22, and is exposed with approximately parallel light 26 whose direction of incidence is inclined to the direction of the rotational axis 24. Because of the clearance between the negative transparency 14 and the positive transparency 16 a reproduction is obtained after development in which density transitions of the original exposure are reproduced by demarcation lines or outlines, thereby simplifying the recognition of contours of continuous structures in many cases. If desired, a still further clearance can be provided between the positive transparency 16 and the image acceptance material 22 and if desired, also the known expedient can be utilized, additionally or alone, so that on copying, the negative and positive transparencies are somewhat displaced from the exact position of registration. However, the process illustrated in FIG. 5, using the rotating table 20, offers the advantage that the outlines obtained are more uniform.

Other embodiments are possible within the scope of the invention.

I claim:

1. A process for providing photographic images of increased contrast in a selected density range, said images being carried by a transparent original, said process comprising the steps of:

photographically applying the image to a transparent photographic material having sharp contrast properties for a graduated series of increasing exposure values to provide a series of negative transparencies having images of varying densities;

selecting that pair of negative transparencies having image densities which correspond approximately to the upper and lower limits of the selected density range, the contrast of which is to be increased;

producing a corresponding positive transparency from the one of the selected negatives produced by the greater exposure value;

superimposing, in proper registration the positive transparency on the other negative transparency of the selected pair to provide a transparency sandwich; and exposing a receiver through the transparency sandwich to reproduce the original with the increased contrast images.

2. The process according to claim 1 further defined as providing a plurality of transparency sandwiches of differing density ranges.

3. A process according to claim 1, wherein the receiver comprises a display screen for direct observation.

4. A process according to claim 1, wherein the receiver comprises a photographic image acceptance material which is processed to provide a permanent reproduction.

5. A process according to claim 1 wherein the exposure step is further defined as exposing the receiver in a manner to enhance the selected density range of the transparent sandwich within the density defining properties of the receiver.

6. A process according to claim 5 wherein the density defining properties of the receiver are responsive to exposure and processing conditions and wherein the exposure and processing conditions of the receiver are selected to provide the greatest possible exploitation of the density range of the receiver for the selected density range enhanced by the transparency sandwich.

7. A process according to claim 4, wherein the receiver comprises an image acceptance material the hardness of which is flatter than the hardness of the transparent photographic material used for the transparency sandwich.

8. A process according to claim 4, wherein a sufficiently hard photographic image acceptance material is used in order to produce an iso-density reproduction.

9. A process according to claim 4, wherein a coloured reproduction is produced.

10. A process according to claim 9, wherein a monochromatic coloured reproduction is produced.

11. The process according to claim 2 wherein the receiver comprises a photographic image acceptance material which is processed to provide a permanent reproduction and wherein a reproduction is made of each of said transparency sandwiches.

12. The process according to claim 11 wherein the reproduction of each of said transparency sandwiches is made in a different monochromatic color.

13. A process according to claim 12, wherein several of the monochromatic colour reproductions are produced in different colours on transparent material and evaluated superimposed one on the other.

14. A process according to claim 13, wherein a photograph on colour-sensitive image acceptance material is produced from the superimposed color transparent materials.

15. A process according to claim 1 wherein the receiver is a photographic image acceptance material and, during exposure of the image acceptance material to light through the transparency sandwich, the image acceptance material and the sandwich are rotated about an axis inclined to the direction of incidence of the light, the photographic image acceptance material being subsequently developed to form an outline picture in which density transitions in the original exposure are represented by demarcation lines.

16. A process according to claim 15, wherein the negative transparency and the positive transparency are offset one with respect to the other to an extent that corresponds to the width of the desired demarcation lines.

17. A process according to claim 15, wherein exposure of the image acceptance material is effected with substantially parallel light rays.

18. A process according to claim 15, wherein the rotational axis is substantially normal to the sandwich and to the image acceptance material which is exposed therethrough.

19. A process according to claim 15, wherein the sandwich and the image acceptance material are spaced apart by a distance corresponding to the desired thickness of the demarcation lines.

20. A process according to claim 15, wherein the positive transparency and the negative transparency are spaced apart by a distance corresponding to the desired thickness of the demarcation lines.

21. The process according to claim 1 wherein the selecting step comprises selecting a pair of negatives having adjacent exposure values in the graduated series and producing a corresponding positive transparency from the one of said negatives having a greater exposure value.

22. The process according to claim 1 wherein the initial step of the process is further defined as applying the image for a graduated series of increasing exposure times.

23. The process according to claim 4 wherein said photographic image acceptance material is of the black and white type.

* * * * *

UNITED STATES PATENT AND TRADEMARK OFFICE

CERTIFICATE OF CORRECTION

PATENT NO. : 4,121,937

DATED : October 24, 1978

INVENTOR(S) : Karl Heinz Lohse

It is certified that error appears in the above-identified patent and that said Letters Patent are hereby corrected as shown below:

| | | | |
|---|---|---|---|
| Column | 1, | Line 39, | Cancel "greater" and substitute therefor ---less--- |
| Column | 1, | Line 51, | Cancel "in" and substitute therefor ---is--- |
| Column | 2, | Line 13, | After "transparencies" cancel ---of--- |
| Column | 2, | Line 14, | Cancel "varying densities" and substitute therefor ---reflecting different density levels of the original--- |
| Column | 2, | Line 17, | After "transparencies" cancel "hav-" |
| Column | 2, | Line 18, | Cancel "ing densities" and substitute therefor ---reflecting density levels--- |
| Column | 3, | Line 11, | After "density" insert --- range--- |
| Column | 5, | Line 25, | After "density" insert ---level--- |

UNITED STATES PATENT AND TRADEMARK OFFICE

CERTIFICATE OF CORRECTION

PATENT NO. : 4,121,937

DATED : October 24, 1978

INVENTOR(S) : Karl Heinz Lohse

It is certified that error appears in the above-identified patent and that said Letters Patent are hereby corrected as shown below:

| | | |
|---|---|---|
| Column 5, | Line 26, | After "density" insert ---level--- |
| Column 6, | Line 15, | After "of" insert ---a--- |
| Column 6, | Line 16, | After "density" insert ---level--- |
| Column 6, | Line 43, | After "providing" insert ---a---; and after "photographic" cancel "images" and insert ---reproduction--- |
| Column 6, | Line 44, | Before "increased" insert ---a transparent original image, said image having varying image densities, said reproduction exhibiting---; after "range" cancel "said im-" |
| Column 6, | Line 45, | Cancel "ages being carried by a transparent original" and substitute therefor --- of original image densities--- |
| Column 6, | Line 51, | Cancel "having images of varying densities" and substitute therefor ---evincing different density levels of the original image--- |

UNITED STATES PATENT AND TRADEMARK OFFICE

CERTIFICATE OF CORRECTION

PATENT NO. : 4,121,937

DATED : October 24, 1978

INVENTOR(S) : Karl Heinz Lohse

It is certified that error appears in the above-identified patent and that said Letters Patent are hereby corrected as shown below:

| | | |
|---|---|---|
| Column 6, | Line 52, | Cancel "selecting that" and insert ---utilizing the--- and after "transparencies" cancel "having" |
| Column 6, | Line 53, | Cancel "image densities which correspond" and substitute therefor ---evincing density levels corresponding--- |
| Column 6, | Line 54, | After "limits" insert --- , respectively,--- |
| Column 6, | Line 59, | After "registration" insert a comma ---,--- |
| Column 6, | Line 64, | After "to" cancel "reproduce" and substitute therefor --- obtain the reproduction of ---; after "original" insert --- image--- |
| Column 6, | Line 65, | After "contrast" cancel "images" |
| Column 7, | Line 10, | Cancel "transparent" and substitute therefor---transparency--- |

UNITED STATES PATENT AND TRADEMARK OFFICE

CERTIFICATE OF CORRECTION

PATENT NO. : 4,121,937

DATED : October 24, 1978

INVENTOR(S) : Karl Heinz Lohse

It is certified that error appears in the above-identified patent and that said Letters Patent are hereby corrected as shown below:

| | | |
|---|---|---|
| Column 7, | Line 18, | Cancel "enhanced" and substitute therefor ---the contrast of which is increased--- |
| Column 7, | Line 21, | Cancel "an" and substitute therefor ---a photographic--- |
| Column 8, | Line 11, | After "original" cancel "exposure" and substitute therefor ---image--- |
| Column 8, | Line 34, | Cancel "selecting" (Both occurrences) and substitute therefor --- utilizing--- |

Signed and Sealed this

*Twentieth* Day of *March 1979*

[SEAL]

*Attest:*

RUTH C. MASON
*Attesting Officer*

DONALD W. BANNER
*Commissioner of Patents and Trademarks*